US009528284B2

(12) United States Patent
Kadar

(10) Patent No.: US 9,528,284 B2
(45) Date of Patent: Dec. 27, 2016

(54) CONCRETE FORM SNAP TIE BREAKER

(71) Applicant: Joseph Antal Kadar, Victoria (CA)

(72) Inventor: Joseph Antal Kadar, Victoria (CA)

(73) Assignee: Kadar Developments Ltd., Victoria, British Columbia ( * ) Notice: Subject to any disclaimer, the term of this patent is extended or adjusted under 35 U.S.C. 154(b) by 55 days.

(21) Appl. No.: 13/999,940

(22) Filed: Apr. 7, 2014

(65) Prior Publication Data

US 2015/0284966 A1 Oct. 8, 2015

(51) Int. Cl.

| | |
|---|---|
| ***B26F 3/02*** | (2006.01) |
| ***E04G 17/06*** | (2006.01) |
| ***B26F 3/00*** | (2006.01) |

(52) U.S. Cl.

CPC ..... *E04G 17/0642* (2013.01); *B26F 3/002* (2013.01); *Y10T 225/364* (2015.04)

(58) Field of Classification Search

CPC ... E04G 17/0642; B26F 3/002; Y10T 225/364

USPC ..... 225/102, 103; 254/131, 23

See application file for complete search history.

(56) References Cited

U.S. PATENT DOCUMENTS

| | | | | | |
|---|---|---|---|---|---|
| 1,932,540 | A * | 10/1933 | Whipple | E04G 17/0642 | 254/29 A |
| 2,419,511 | A * | 4/1947 | Vaughan, Jr. | H02G 1/1231 | 30/90.7 |
| 2,733,736 | A * | 2/1956 | McLaughlin | B23D 23/00 | 140/149 |
| 2,777,479 | A * | 1/1957 | Beanum | E04G 17/0642 | 140/149 |
| 3,546,919 | A * | 12/1970 | Fial | E04G 17/0642 | 140/123 |
| 3,633,867 | A * | 1/1972 | Eriksson | E04G 17/0642 | 249/190 |
| 3,651,835 | A * | 3/1972 | Eriksson | B23D 21/00 | 140/149 |
| 3,722,555 | A * | 3/1973 | Voelsch | E04G 17/0642 | 140/123 |
| 4,194,286 | A * | 3/1980 | Kearns | B23D 29/023 | 225/102 |
| 5,197,362 | A * | 3/1993 | Birkestrand | B23B 5/163 | 408/135 |
| 8,628,063 | B1 * | 1/2014 | Stone | B25F 1/00 | 140/123 |

* cited by examiner

*Primary Examiner* — Omar Flores Sanchez
(74) *Attorney, Agent, or Firm* — George A. Seaby

(57) ABSTRACT

A tool for breaking and removing the outer end of a snap tie, which has an area of weakness and a button outer end, includes a tubular barrel containing a first jaw and a lever extending into the barrel having a second jaw in opposition to the first jaw. The lever is pivotally connected to the barrel for rotating the second jaw toward the first jaw so that the button can be clamped and the snap tie twisted to break the tie bar at the area of weakness.

3 Claims, 4 Drawing Sheets

CONCRETE FORM SNAP TIE BREAKER

FIELD OF THE INVENTION

This invention relates to a tool for breaking and removing the outer end of a concrete snap tie.

BACKGROUND OF THE INVENTION

Concrete walls, e.g. basement walls are typically made by constructing wooden forms including parallel, spaced apart wooden panels interconnected by snap ties extending beyond the outer surfaces of the panels. After the wall has been poured and partially set, the panels are removed. Before removing the panels, each snap tie is broken at a pre-determined location, which is defined by a zone of weakness. The zone of weakness, which is a short distance inside the poured concrete, can be a pre-formed groove in the tie bar. Breaking a tie bar is often difficult, because the bars are formed of metal. There are many devices described in the patent literature for breaking tie bars. Examples of such devices are disclosed by U.S. Pat. No. 2,777,479, issued to E. Beanum on Jan. 15, 1957; U.S. Pat. No. 3,546,917, issued to F. J. Fial on Dec. 15, 1970; U.S. Pat. No. 3,722,555, issued to Delwin F. Boelsch on Mar. 27, 1973; U.S. Pat. No. 4,309,369 issued to Richard M. Overton on Jan. 5, 1982, and U.S. Pat. No. 6,619,332, issued to Paul Edward Prunty on Sep. 16, 2003. In general, the devices described in the prior art operate by bending and twisting the snap tie. The Prunty device (U.S. Pat. No. 6,619,332) breaks a snap tie by bending and twisting the tie. The device is somewhat complicated, including a shaft, a handle, and a pair of tubes.

SUMMARY OF THE INVENTION

The present invention provides a relatively simple tool for breaking and removing the outer end of a concrete snap tie of the type including a zone of weakness and a button on its outer end. The tool includes a tubular barrel having at least one open end; a first jaw extending longitudinally along one side of the interior of the barrel from said at least one open end; an elongated lever pivotally connected proximate one of its ends to the exterior of the barrel for rotation around an axis parallel to the longitudinal axis of the barrel, said one end of the lever extending through a notch in one end of the barrel and being rotatable in the notch; a second jaw on said one end of the lever in the barrel opposing said first jaw, whereby the lever can be rotated between an open position and a clamping position around one end of a snap tie, and further rotated to cause the snap tie to break at a zone of weakness therein.

BRIEF DESCRIPTION OF THE DRAWINGS

The invention is described hereinafter in greater detail with reference to the accompanying drawings, which illustrate a preferred embodiment of the invention, and wherein.

DETAILED DESCRIPTION OF PREFERRED EMBODIMENTS

Figure 1:
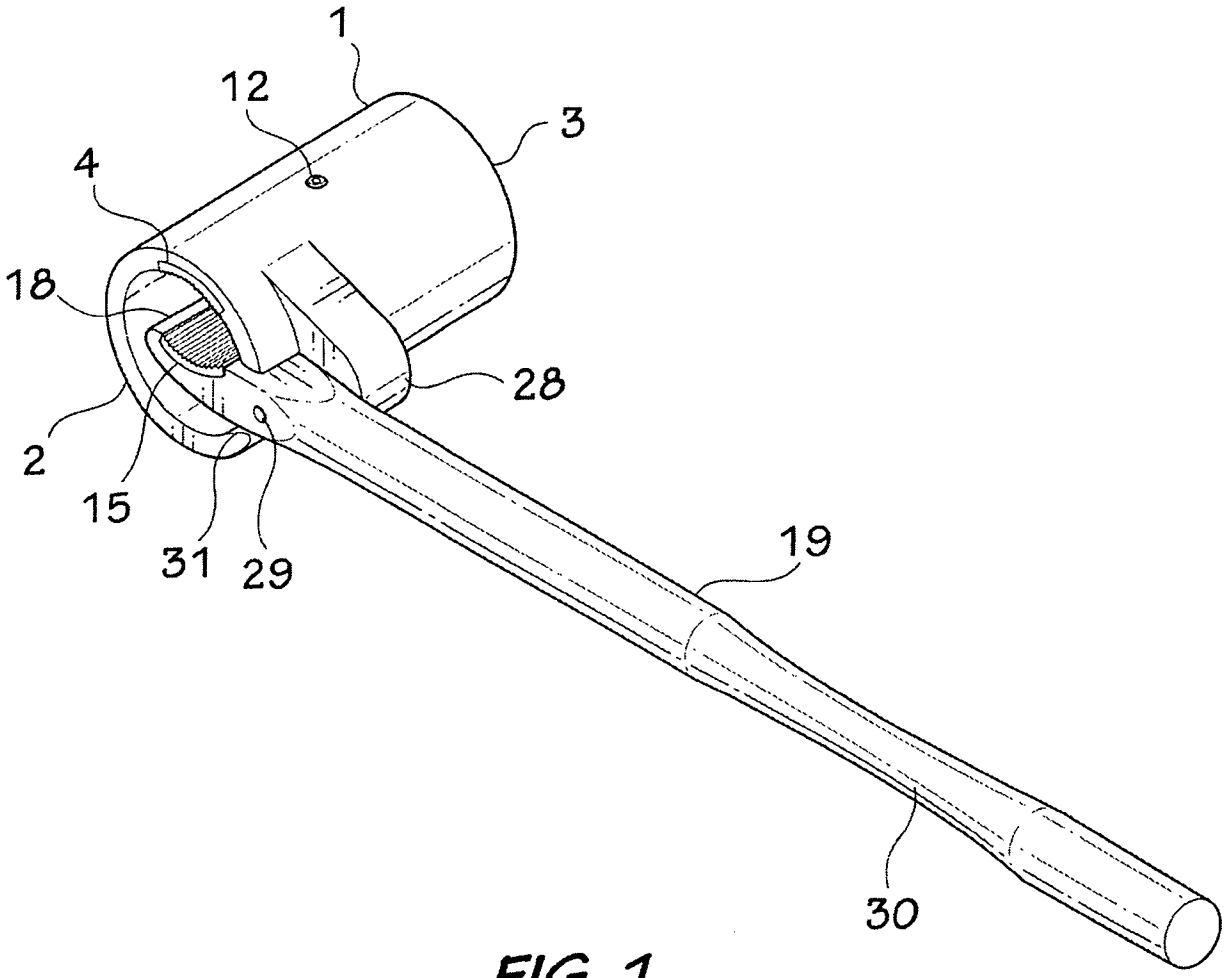
FIG. 1 is an isometric view of a tool in accordance with the invention.
Figure 2:
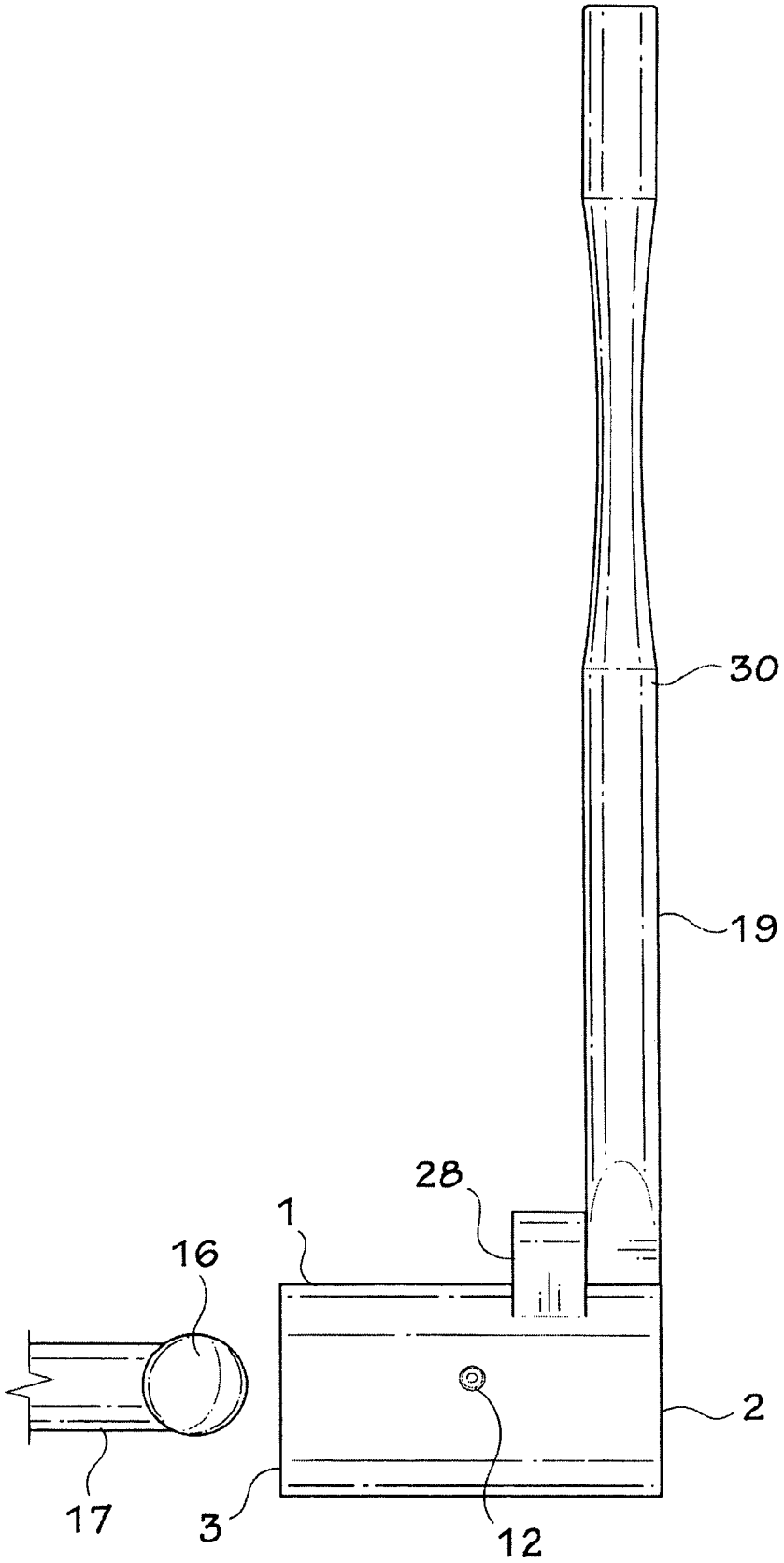
FIG. 2 is a top view of the tool of FIG. 1.
Figure 3:
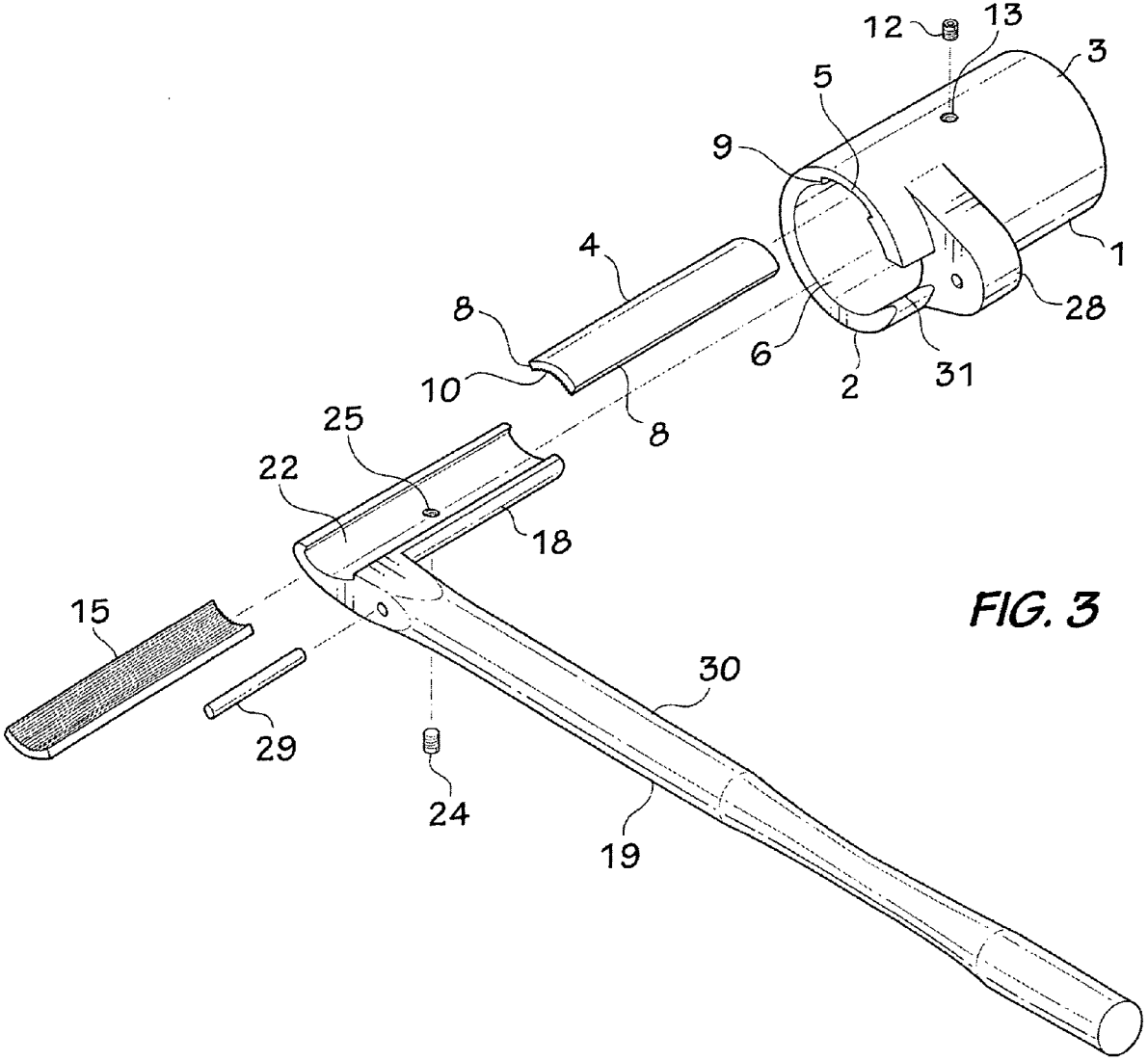
FIG. 3 is an exploded isometric view of the tool of FIGS. 1 and 2.
Figure 4:
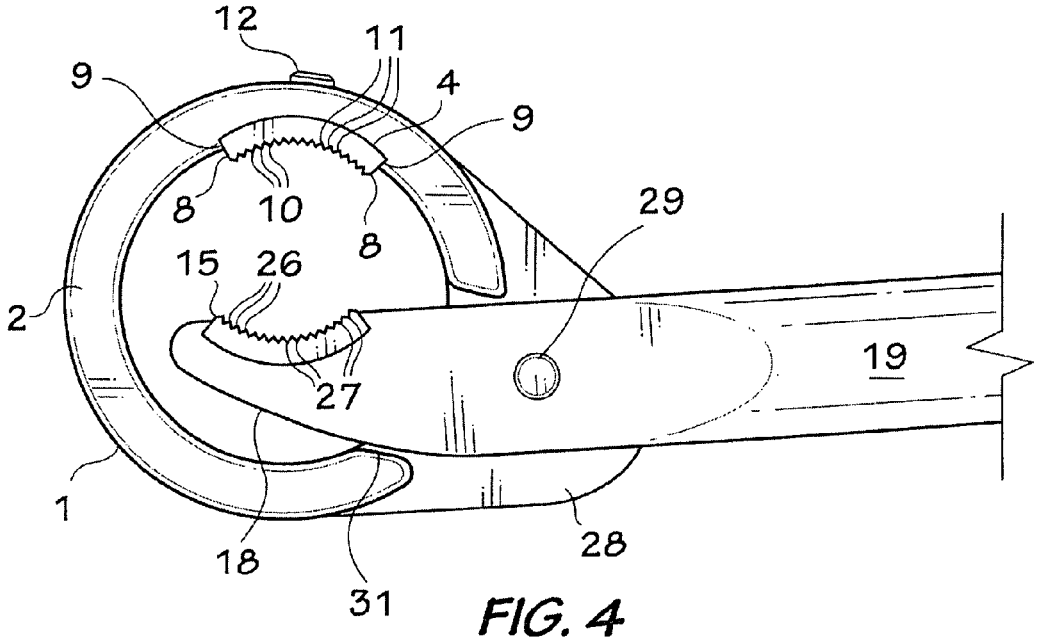
FIGS. 4 and 5 are end views of the tool of FIGS. 1 to 3 in the open and use conditions, respectively.

With reference to FIGS. 1 to 3, the tool includes a tubular barrel 1 having open ends 2 and 3. A first jaw 4 is mounted in a groove 5 extending the length of the interior 6 of the barrel 1. There is a sliding dovetail joint between the jaw 4 and the barrel 1. For such purpose the jaw 4 and the groove 5 have outwardly diverging sides 8 and 9, respectively. The jaw 4 is arcuate in cross section and has essentially the same curvature as the interior of the barrel. As best shown in FIG. 4, alternating teeth 10 and grooves 11 extend the entire length of the jaw 4. The jaw 4 is releasably locked in position by a set screw 12 extending through a threaded hole 13 in the barrel 1 into engagement with the jaw. Thus, the jaw 4 can readily be replaced with a new jaw.

Figure 5:
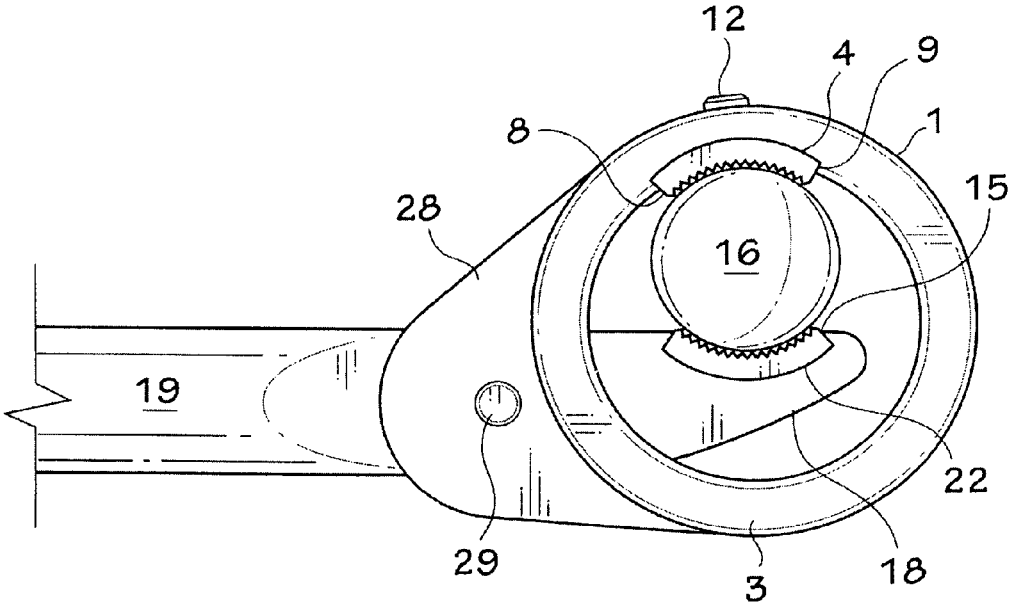

A second jaw 15 opposes the jaw 4 in the barrel 1 for grasping a button 16 (FIGS. 2 and 5) on the outer end of a tie bar 17 (FIG. 2). The second jaw 15 is in an arm 18 on the inner end of a generally L-shaped lever 19. The jaw 15 is removably mounted in a concave groove 22 in the shorter inner arm 18 of the lever 19. The jaw 15 has the same cross sectional shape as the jaw 4, and the groove 22 has the same shape as the groove 5. The jaw 15 is releasably locked in place by a set screw 24 extending through a hole 25 in the arm 18 into engagement with the jaw. Thus, the jaw 15 can also be readily be replaced when worn. Like the jaw 4, the jaw 15 includes longitudinally extending alternating teeth 26 and grooves 27 (FIG. 4).

The lever 19 is pivotally connected to a lug 28 extending outwardly from one side of the barrel 1 by a pin 29. During assembly, the arm 18 with the jaw 15 therein is slid into the end 2 of the barrel 1 until the long arm or handle 30 of the level 19 enters a notch 31 (FIGS. 1, 3 and 4) in the barrel and abuts the leg 28. When the tool is assembled, the jaws 4 and 15 oppose each other. By placing the end 3 of the barrel 1 over a button 16 on the outer end of a tire bar 17 and rotating the lever 19 to the clamping position shown in FIG. 5 and then beyond the clamping position, the tie bar can be twisted around its longitudinal axis to break the snap tie at the zone of weakness. It will be appreciated that the button 16 can be grasped by either ends of the jaws 4 and 15, i.e. either end 2 or 3 of the barrel 1 can be positioned around the button 16.

The invention claimed is:

1. A tool for engaging and removing the outer end of a snap tie comprising:

a tubular barrel having first and second open ends for receiving the outer end of a snap tie;

a first jaw removably mounted in said barrel and extending longitudinally along one side of the interior of the barrel from the first open end to the second open end;

a notch in one end of the barrel;

an elongated lever pivotally connected proximate one of its ends to the exterior of the barrel for rotation around an axis parallel to the longitudinal axis of the barrel, said one end of the lever extending through the notch in said one end of the barrel and being rotatable in the notch;

a second jaw removably mounted on said one end of the lever in the barrel opposing said first jaw and extending longitudinally in the barrel from said first open end to the second open end, whereby, when either end of the barrel is placed over the outer end of the snap tie, the lever can be rotated between an open position and a clamping position around one end of the snap tie, and further rotated in the same direction to cause the snap tie to break at a zone of weakness therein.

2. The tool of claim 1, wherein said jaws are connected to said barrel and said lever by dovetail joints and screws to facilitate replacing of the jaws.

3. The tool of claim 2, including a lug on said barrel proximate said notch, and a pin extending through said lever and said lug for pivotally connecting the lever to the lug.

* * * * *